US005471843A

United States Patent [19]

Chretien

[11] Patent Number: 5,471,843

[45] Date of Patent: Dec. 5, 1995

[54] PROCESS AND INSTALLATION FOR THE PRODUCTION OF OXYGEN AND/OR NITROGEN UNDER PRESSURE AT VARIABLE FLOW RATE

[75] Inventor: Denis Chretien, Saint Mande, France

[73] Assignee: L'Air Liquide, Societe Anonyme pour l'Etude et l'Exploitation des Procedes Georges Claude, Paris, France

[21] Appl. No.: 306,309

[22] Filed: Sep. 15, 1994

Related U.S. Application Data

[63] Continuation-in-part of Ser. No. 257,691, Jun. 6, 1994.

[30] Foreign Application Priority Data

Jun. 18, 1993 [FR] France ..... 93 07395

[51] Int. Cl.[6] ..... F25J 3/00

[52] U.S. Cl. ..... 62/36; 62/40; 62/41; 62/37; 62/38

[58] Field of Search ..... 62/37, 38, 40, 62/41, 24, 36

[56] References Cited

U.S. PATENT DOCUMENTS

| | | | |
|---|---|---|---|
| 3,056,268 | 10/1962 | Grenier | 62/40 X |
| 3,214,925 | 11/1965 | Becker . | |
| 3,485,053 | 12/1969 | Grenier | 62/37 X |
| 3,648,471 | 3/1972 | Basin et al. | 62/41 X |
| 3,760,596 | 9/1973 | Basin et al. | 62/41 X |
| 3,912,476 | 10/1975 | Mikawa et al. | 62/37 |
| 4,303,428 | 12/1981 | Vandenbussche | 62/41 X |
| 4,732,595 | 3/1988 | Yoshino | 62/37 X |
| 4,853,015 | 8/1989 | Yoshino | 62/40 |
| 5,081,845 | 1/1992 | Allam et al. | 62/38 X |
| 5,082,482 | 1/1992 | Darredeau | 62/41 X |
| 5,084,081 | 1/1992 | Rohde | 62/41 X |
| 5,129,932 | 7/1992 | Agrawal et al. | 62/22 |
| 5,251,449 | 10/1993 | Rottmann | 62/41 X |
| 5,329,776 | 7/1994 | Grenier | 62/24 |
| 5,337,571 | 8/1994 | Ducrocq et al. | 62/41 X |
| 5,341,647 | 8/1994 | Koeberle et al. | 62/41 X |

FOREIGN PATENT DOCUMENTS 0029656 6/1981 European Pat. Off. .

*Primary Examiner*—Christopher Kilner
*Attorney, Agent, or Firm*—Young & Thompson

[57] ABSTRACT

Process and installation for the production of a variable flow rate of at least one principal constituent of air under pressure, of the type in which the constituent is withdrawn in liquid phase from an air distillation apparatus (12), tills liquid is brought to a vaporization pressure, and the liquid is vaporized under this vaporization pressure by heat exchange (in 9; 25) with a calorigenic fluid under pressure. The flow rate of the product constituent is adjusted by modifying the flow rate of the liquid to be vaporized and the vaporization pressure. The vaporization pressure is intermediate the withdrawal pressure and the production pressure, and the gas resulting from the vaporization is compressed to the production pressure (in 20). The modification is effected so as to permit the compressor (20) of the resulting gas to follow its characteristic curve (1), and, to effect this modification, the liquid to be vaporized is throttled in a variable manner (in 18), or the liquid to be vaporized is pumped by a variable speed pump, or the liquid to be vaporized is pumped (in 17) by a constant speed pump, and a variable flow of it is returned (in 24)to the distillation apparatus (12), the rest of the liquid being vaporized.

17 Claims, 3 Drawing Sheets

PROCESS AND INSTALLATION FOR THE PRODUCTION OF OXYGEN AND/OR NITROGEN UNDER PRESSURE AT VARIABLE FLOW RATE

This application is a continuation-in-part of copending application Ser. No. 08/257,691 filed Jun. 6, 1994.

The present invention relates to the production of gaseous oxygen and/or nitrogen under pressure at a variable flow rate. It relates in the first instance to a process for the production of a variable flow of at least one principal constituent of air under pressure, of the type in which the constituent is withdrawn in liquid phase from an air distillation apparatus, this liquid is brought to a vaporization pressure, and the liquid is vaporized under the vaporization pressure by heat exchange with a calorific fluid under high pressure.

The principal application of the invention is to the production of gaseous oxygen under pressure at a variable flow rate, and this is why the invention will be explained hereinafter with reference to this use.

The pressures in question hereinafter are absolute pressures.

Air distillation apparatus is generally of the double column type and comprises a medium pressure column and a low pressure column coupled by a vaporizer-condenser. In the so-called "pump" apparatuses, liquid oxygen withdrawn from the base of the low pressure column is pumped to a relatively high pressure, then is vaporized under this pressure, generally in the heat exchange line associated with the double column and by heat exchange with air in the course of liquefaction.

This technique, which very advantageously permits avoiding the use of a compressor for gaseous oxygen, which is difficult to use, is however limited by the fact that the pressure of the calorific air increases rapidly with the vaporization pressure of the oxygen. Thus, a vaporization pressure of 12 bars corresponds to an air pressure of about 25 bars. An air pressure near the critical pressure (about 38 bars) is rapidly reached, for which the stage of air condensation disappears. It is thus necessary to compress to high pressure a very large flow of air, and the energy consumption becomes prohibitory.

This is why, to produce oxygen under high pressure, typically of the order of 40 to 50 bars, it is useful to vaporize oxygen under an intermediate pressure, typically of the order of 12 bars, and to compress the gaseous oxygen under this pressure leaving the warm end of the heat exchange line. It is in this context that the invention has its principal interest, which will be explained in this application.

When the demand for oxygen under pressure varies, there are the following phenomena, which will be explained with respect to FIGS. 2 and 3 of the accompanying drawings.

There exists for each component of the installation a relation between the operating pressure and the flow rate, the so-called characteristic curve. The elements can be classified in two categories according to the appearance of the characteristic curves:

(1) Compressors: For a centrifugal compressor, as a first approximation, the characteristic curve 1 connects the compressor load TC to the actual inlet flow rate D (FIG. 2)

When the flow rate decreases, the compressor load increases. Below a certain flow rate a pumping phenomenon takes place, which is an unstable and dangerous manner of operation for the machine. It is therefore not possible to decrease the flow rate below a limit of 2, the locus of these limits forming a curve 3 called an anti-pumping curve. For a given speed of rotation and a given compressor geometry, the characteristic curve is unique. The characteristic curve can be changed, either by changing the speed of rotation, or by acting on particular members called blading or variable blades (or movable blades).

Moreover, according to the place in which the operative point is located on the characteristic curve, the output of the compressor is affected. The equal output curves are shown at 4 in FIG. 2. The central curves correspond to the best output for the operative points relatively close to the anti-pumping curve.

(2) Static elements (purification apparatus by adsorption and heat exchange line):

The characteristic curve 5 is much simpler (FIG. 3). It is a single curve of pressure P/flow rate D, rising from the origin.

When the flow rate varies, the operative points of the different components are displaced according to characteristics which are not necessarily mutually compatible. It therefore is necessary to add adjustment means, which are valves or blading.

When the product oxygen flow rate decreases, the oxygen compressor follows its characteristic curve, and the compression load increases. With a conventional in-line compressor, of constant speed and without variable blading, it is usual to install an input valve for the compressor to decrease the input pressure and thereby to permit the increase of the compression load and the obtention of the required production pressure. The operative point then displaces from A to B (FIG. 2). This pressure drop, however, represents a loss of energy at low flow rate.

This loss can be limited by using a compressor provided at its inlet with variable blades, which permits changing its characteristic. There is thus no need to throttle the intake, and the operative point displaces from A to C upon a reduction of flow rate. However, the use of variable blades on an oxygen compressor is delicate and uncommon.

On the other hand, when the oxygen flow rate decreases, the flow rate of the air supercharger must also decrease to maintain the thermal balance, and the flow rate of entering air must itself also, at least if the installation produces no liquid, be reduced to maintain the material balance. The curve of FIG. 3, applicable to the heat exchange line, shows that the pressure of the distillation apparatus, and in particular the medium pressure, falls. The high pressure being constant, the compression load of the supercharger therefore increases, and the operative point follows its characteristic curve, which is again of the type shown in FIG. 2. For this air supercharger, it is easier to use compressors, with a so-called integrated multiplier, with variable blades, and the adaptation of the characteristic of the compressor to that of the double column is easily effected. However, the required flexibility affects the output in the following way: when it is not possible that the decreased flow rate (for example the point B in FIG. 2) be less than that of the pump, the normal operating point A is displaced toward the right, toward the low equal output curves. It is moreover to be noted that the oxygen compressor is penalized in the same manner when operating at normal flow rate.

In short, it will be seen that the flexibility required for the oxygen flow rate under pressure has unfavorable consequences on energy consumption, on the one hand because of the pressure drop of the gaseous oxygen, on the other hand because of the requirement to operate the oxygen compressors and the air supercharger with relatively mediocre output.

The invention has for its object to improve the overall performances of the installation, both at reduced flow rates and at nominal flow rate, all the while without having recourse to variable blades, which are delicate to use, for the final compressor.

To this end, the invention has for its object a process of the type described, characterized in that the flow rate of said constituent product is adjusted by modifying the flow rate of the liquid to be vaporized and said vaporization pressure.

The process can comprise one or several of the following characteristics:

—the vaporization pressure is intermediate the withdrawal pressure and the production pressure, and the gas resulting from vaporization is compressed to the production pressure;

—this modification is effected in a manner such as to permit the resulting gas compressor to follow its characteristic curve;

—to effect said modification, the liquid to be vaporized is throttled in a variable manner;

—to effect said modification, the liquid to be vaporized is pumped by means of a variable speed pump;

—to effect said modification, the liquid to be vaporized is pumped by means of a constant speed pump, and variable amount thereof is returned to the distillation apparatus, the rest of the liquid being vaporized;

—the liquid is vaporized by indirect heat exchange with the calorific fluid, particularly air, that is being liquefied;

—the liquid is vaporized by injecting it into the head of a mixture column supplied at the base by gaseous air compressed to the same pressure.

The invention also has for its object an installation for practicing such a process. This installation, of the type comprising an air distillation apparatus, means to withdraw a liquid from this apparatus, means to bring the withdrawn liquid to a vaporization pressure, a compressor for calorific fluid, and means to vaporize the liquid under said vaporization pressure by heat exchange with the calorific fluid under pressure, is characterized in that it comprises means for adjusting the flow rate of the liquid to be vaporized and for adjusting said vaporization pressure.

An example of an embodiment of the invention will now be described with regard to the accompanying drawings, in which.

Figure 1:
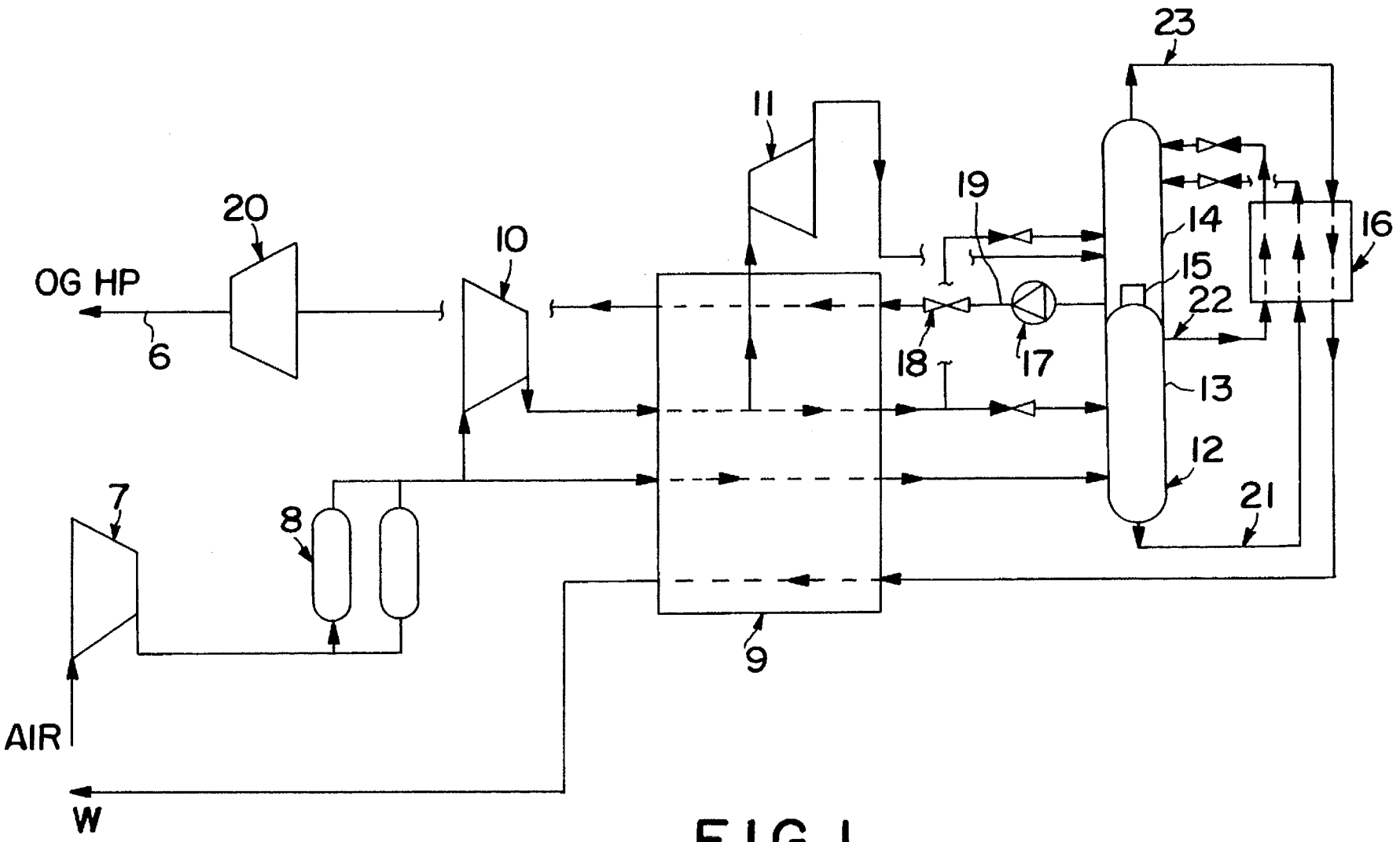
FIG. 1 shows schematically a gaseous oxygen production installation according to the invention.
Figure 3:
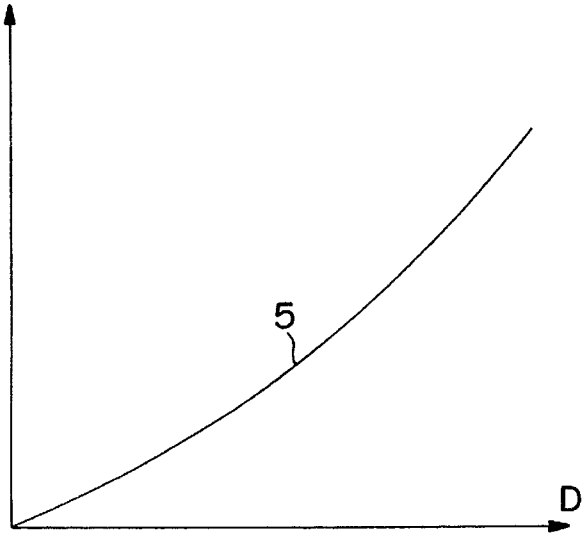
FIG. 3 is a characteristic curve of the operation of the passive components of the installation.

The installation shown in FIG. 1 is adapted to supply a variable flow rate of gaseous oxygen under high pressure, for example about 40 bars, via a product outlet conduit 6. It comprises essentially: an atmospheric air compressor 7; an apparatus for purification from water and carbon dioxide by adsorption; a heat exchange line 9; an air supercharger 10 with variable blades; an expansion turbine 11; a double distillation column 12 comprising itself a medium pressure column 13 surmounted by a low pressure column 14, the head of the column 13 being coupled to the base of the column 14 by a vaporizer-condenser 15; a subcooler 16; a liquid oxygen pump 17 with constant speed of rotation; a throttle valve 18 mounted in the output conduit 19 of this pump; and an oxygen compressor 20 having no variable blades.

The double column is provided with conventional conduits 21 for raising "rich liquid" (air enriched in oxygen), 22 for raising "poor liquid" (nearly pure nitrogen), these two conduits connecting the medium pressure column 2 to the low pressure column and being provided with respective expansion valves, and conduit 23 for the evacuation of residual gas W (impure nitrogen) from the summit of column 14, the residual gas subcooling the rich liquid and the poor liquid in the subcooler 16.

At nominal operation, atmospheric air compressed in 7 to the medium pressure of the column 13 and purified in 8, is divided into two flows: a first flow which is cooled in 9 to about its dew point and introduced into the base of the column 13; and a second current which is supercharged in 10 to a high pressure adapted to the vaporization pressure of the liquid oxygen. The supercharged air is cooled in 9 to an intermediate temperature T, at which is divided into two fractions: the first fraction which continues its cooling and is liquified, and if desired subcooled, to the cold end of the heat exchange line, then is divided between the columns 13 and 14 after expansion in corresponding expansion valves; and a second fraction which left the heat exchange line, was expanded in 11 to the low pressure and introduced into the column 14, this expansion ensuring the cold supply of the installation. As a modification, the turbine could expand air to the medium pressure, the expanded air being then introduced into the column 13.

Liquid oxygen is withdrawn from the base of the column 14 and brought by the pump 17 to an intermediate pressure. The valve 18 is in its fully opened position, such that this intermediate pressure is substantially the vaporization pressure of the liquid oxygen in the heat exchange line. The vaporized oxygen leaves, at about ambient temperature, the cold end of the heat exchange line and is then compressed to the production pressure by the compressor 20.

When the demand for oxygen decreases, the flow of liquid oxygen at intermediate pressure leaving the pump 17 is throttled by means of the valve 18. The vaporization pressure of the oxygen falls at the same time as the flow rate of liquid oxygen, and the throttling is adjusted so as to permit compressor 20 to follow its characteristic curve. At the same time, the flow rate of air treated is decreased, to maintain the material balance, and the high pressure of the air is also reduced, to maintain the same temperature difference between the air to be liquified and the oxygen to be vaporized. Thus, the compression load of the supercharger 10 increases substantially less, when passing from the nominal flow rate to the reduced flow rate, than in the prior art, recited above, in which the flow of gaseous oxygen which supplies the compressor 20 is throttled, which corresponds to an energy gain.

Figure 4:
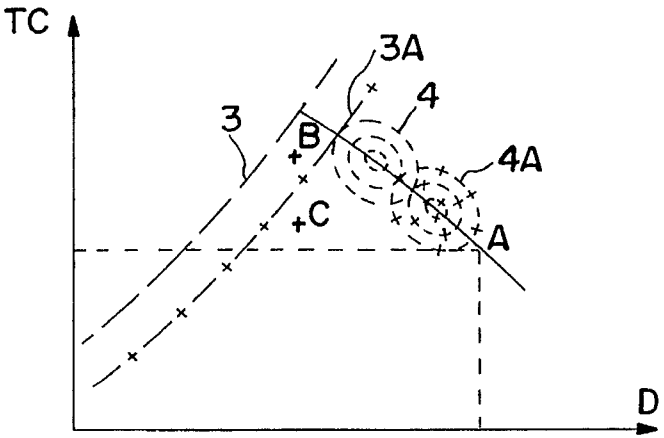
FIG. 4 shows the advantages achieved by the invention.

With reference to FIG. 4, the comparison can be made in the following manner: in the prior art, acting upon variable blades of the supercharger 10, the operative point passes from A, for nominal flow rate, to B, for reduced flow rate. Upon throttling the liquid, the operative point with reduced flow rate passes to C.

Consequently, the compressor can be so designed as to shift to the right the anti-pumping curve, which passes from 3 to 3A. The equal output curves shift correspondingly to the right, from 4 to 4A, and the operation at nominal flow rate then takes place with improved output.

Thus, it will be seen that the simple installation of a throttle valve in the output conduit of the pump 17 permits obtaining both a gain in energy at low flow rates and a gain in output, and hence of energy, at the nominal flow rate.

Figure 5:
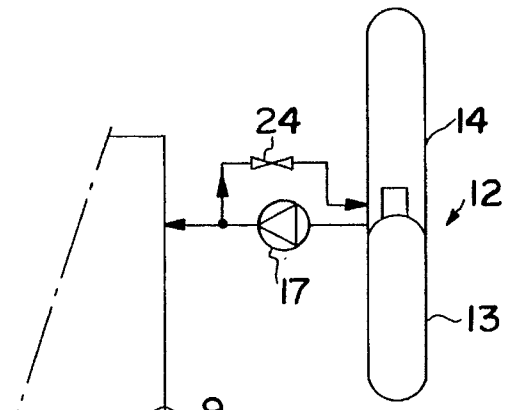
FIG. 5 is a fragmentary schematic view of a modification.
Figure 2:
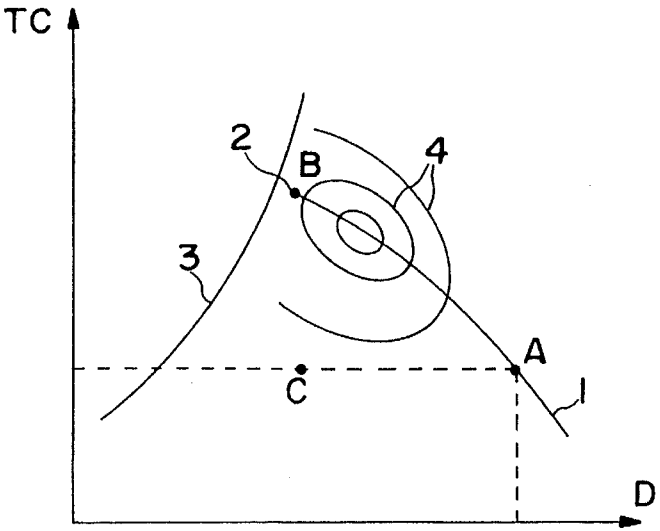
FIG. 2 is a characteristic curve of the operation of the compressors of this installation.

The same principal variation of the vaporization pressure of the liquid oxygen as a function of the flow rate of the gaseous oxygen to be produced can be practiced by other means than the valve 18, all these means being adapted to be used alone or in combination with each other: by driving the pump 17 by means of a variable speed motor, or else as shown in FIG. 5, by returning a variable flow rate of liquid oxygen, controlled by a valve 24, from the output of the pump to the base of the column 14. It is to be noted that in FIG. 5, the other portions of the installation, which are identical to those of FIG. 1, have been omitted for clarity.

According to another variation, the pressure of the liquid oxygen withdrawn from the double column can be increased without the use of a pump, by a hydrostatic head created in a descending conduit.

The invention is applicable also to apparatus for the distillation of air having its own medium pressure air compressor, as described above, as well as to an apparatus integrating a gas turbine.

Moreover, the invention is also applicable to the production of nitrogen under high pressure at variable flow rate. It brings the same advantage relative to the air supercharger (or, more generally, to the compressor of calorific cycle fluid assuring its vaporization), and permits using a final nitrogen compressor without variable blades, which is therefore more economical.

As will be understood, the invention is applicable also to the case in which the installation does not comprise a final compressor 20. The pressure of the oxygen product is thus a function of the flow rate of vaporized oxygen and is defined by the characteristic curve of the consumer equipment.

Figure 6:
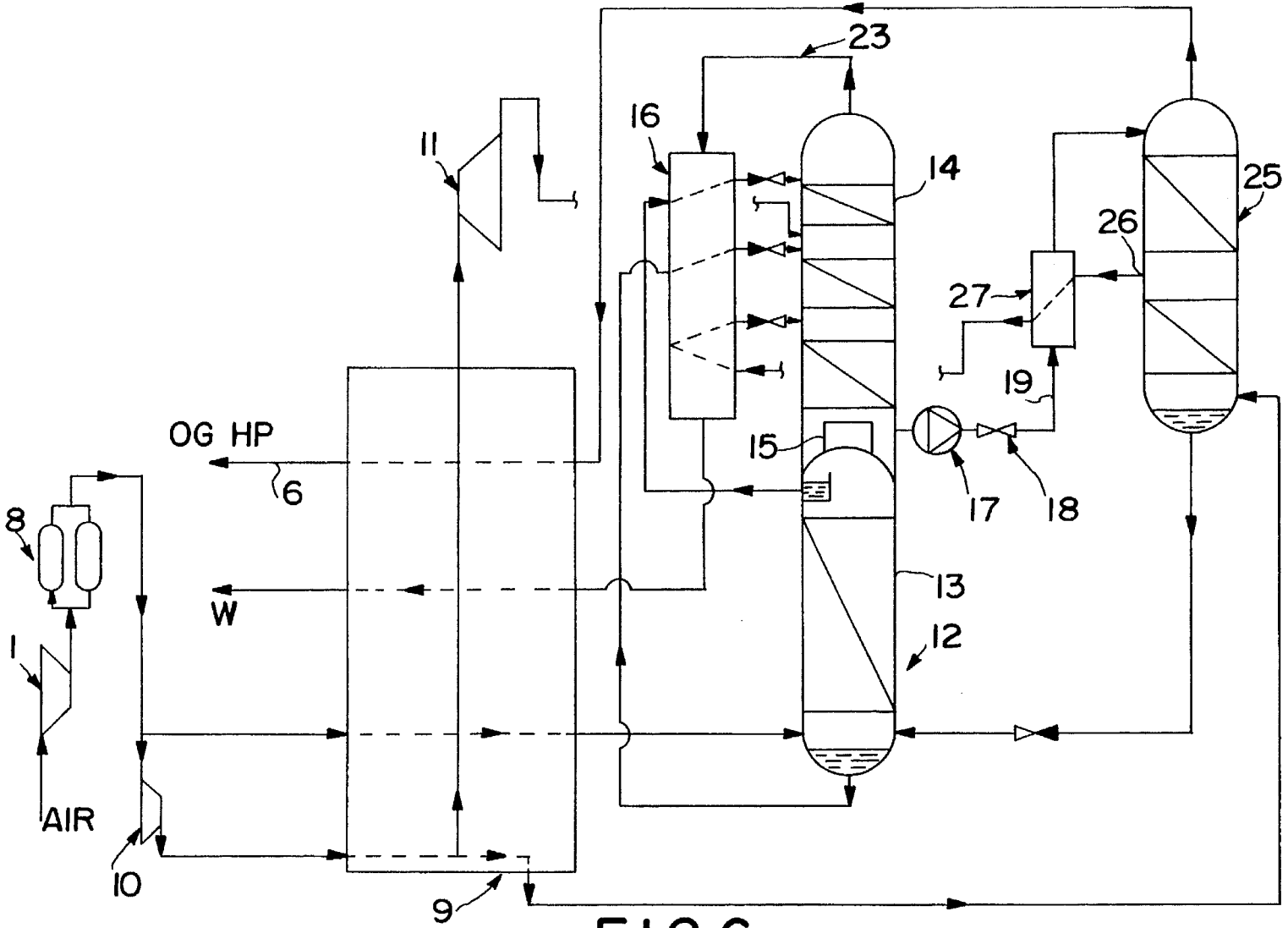
FIG. 6 is a schematic representation of another embodiment of the installation for the production of gaseous oxygen according to the invention.

There will be seen in the installation of FIG. 6, which lacks the final compressor 20, most of the elements of FIG. 1, which bear the same reference numerals. This installation of FIG. 6 differs however from that of FIG. 1 by the manner in which the liquid oxygen withdrawn from the base of column 14 and compressed by the pump 17 is vaporized.

Thus, instead of effecting the vaporization by indirect heat exchange, in the heat exchange line 9, with compressed air at 10, this is achieved by direct contact with the compressed air at 10, in an auxiliary column 25 called a mixture column.

More precisely, the fraction of the air treated which is compressed at 10 is compressed only to the pressure at which is transported the liquid oxygen to be vaporized. This air is in part turbine expanded at 11 as previously, and in part further cooled, to adjacent its dew point, in the heat exchange line 9, then introduced into the base of column 25, which is supplied at its top by liquid oxygen compressed by the pump 17.

In the mixture column, the liquid is progressively impoverished of oxygen as it descends and enriched in nitrogen to become, at the base of the column, a liquid whose composition is near that of the "rich liquid" in equilibrium with the air. Likewise, the gaseous phase of the column 25 is enriched in oxygen from the bottom toward the top, such that there is collected at the head a gas whose content is adjacent that of the liquid oxygen.

So as to-maintain along all the length of the mixture column a suitable reflux ratio, it is necessary to withdraw at an intermediate point 26 an intermediate liquid which, after subcooling in heat exchanger 27 by indirect heat exchange with the subcooled liquid oxygen compressed by the pump 17, is returned for separation at an intermediate point in the low pressure column 14, after expansion to the low pressure in an expansion valve.

The liquid at the base of column 25, which has a composition adjacent that of the "rich liquid" is returned, after expansion in an expansion valve, to the base of the medium pressure column 13, where it mixes with the "rich liquid".

The process of FIG. 6 will therefore be seen as essentially a way of vaporizing the oxygen under pressure by indirect contact with the gaseous air under the same pressure, at the cost of a slight loss of purity between the liquid oxygen withdrawn from the column 14 and the gaseous oxygen product at the head of column 25.

In a manner analogous to that which has been described above with respect to FIGS. 1–4, when the oxygen demand decreases, the flow rate and the pressure of the liquid oxygen to be vaporized are reduced by means of a throttle valve 18 mounted downstream of the pump 17. Simultaneously, the flow of air treated is reduced, to balance the material balance, as well as the pressure of compression of the supercharger 10, which should continuously remain equal to that of the liquid oxygen to be vaporized. The operating pressure of the mixture at column 24 thus floats as a function of the flow rate of the oxygen product.

As before, instead of using the throttle valve 18, recourse could be had to a variable speed pump 17, or to a selective recycle of the liquid oxygen to the column 14 in a manner analogous to that shown in FIG. 5.

It is to be noted that in the embodiment of FIG. 6, if the oxygen must be produced at the medium pressure of the column 13, the supercharger 10 is not necessary, which constitutes a particularly simple modification of the installation.

I claim:

1. In a process for the production of a variable flow rate of at least one principal constituent of air under pressure, of the type in which the constituent is withdrawn in liquid phase from an air distillation apparatus, this liquid is brought to a vaporization pressure, and the liquid is vaporized under this vaporization pressure by heat exchange with a calorific fluid under pressure; the improvement wherein the flow rate of said product constituent is adjusted by modifying the flow rate of the liquid to be vaporized and said vaporization pressure.

2. Process according to claim 1, wherein the vaporization pressure is intermediate the withdrawal pressure and the production pressure, and the gas resulting from the vaporization is compressed to the production pressure.

3. Process according to claim 2, wherein the said modification is effected so as to permit the compressor of the resulting gas to follow its characteristic curve.

4. Process according to claim 1, wherein to effect said modification, the liquid to be vaporized is throttled in a variable manner.

5. Process according to claim 1, wherein to effect said modification, the liquid to be vaporized is pumped by means of a variable speed pump.

6. Process according to claim 1, wherein to effect said modification, the liquid to be vaporized is pumped by means of a constant speed pump, and a variable flow of it is returned to the distillation apparatus, the rest of the liquid being vaporized.

7. Process according to claim 1, wherein the liquid is vaporized by indirect heat exchange with the calorific fluid which is liquefied.

8. Process according to claim 1, wherein the liquid is vaporized by injecting it into the head of a mixture column supplied at its base by the gaseous air compressed to the same pressure.

9. In an installation for the production of a variable flow rate of at least one principal constituent of air under pressure, comprising an air distillation apparatus, means to withdraw a liquid from this apparatus, a pump to bring the withdrawn liquid to a vaporization pressure, a calorific fluid compressor, and means to vaporize the liquid under said vaporization pressure by heat exchange with the calorific fluid under pressure; the improvement which comprises means for adjusting the flow rate of the liquid to be vaporized and for regulating said vaporization pressure.

10. Installation according to claim 9, which further comprises a compressor to bring the resulting gas from said vaporization to the production pressure.

11. Installation according to claim 10, wherein the compressor is free from variable blades at its inlet.

12. Installation according to claim 10, wherein the compressor is driven by a constant speed motor.

13. Installation according to claim 9, which further comprises a pump of constant speed connected upstream to the distillation apparatus and downstream of said means for vaporization of the liquid, and the adjustment means comprise a throttle valve mounted in the output conduit of this pump.

14. Installation according to claim 9, which further comprises a pump driven by a variable speed motor, connected upstream of the distillation apparatus and downstream of said means for vaporization of the liquid.

15. Installation according to claim 9, which further comprises a return conduit, provided with a flow rate adjustment valve, connecting the output of the pump to the distillation apparatus.

16. Installation according to claim 9, wherein said vaporization means comprise vaporization passages of a heat exchanger which are in indirect heat exchange relation with liquefaction passages for the supercharged air of the same heat exchanger.

17. Installation according to claim 9, wherein said vaporization means comprise a mixture column operating under said vaporization pressure, supplied at its head by the liquid to be vaporized and at its base by the gaseous air at the same pressure.

* * * * *